US005975157A

United States Patent [19]

Ashford

[11] Patent Number: 5,975,157

[45] Date of Patent: Nov. 2, 1999

[54] OIL DRAINING DEVICE

[76] Inventor: Jason Ashford, Apt. 104 2277 Mc Gill Street, Vancouver, B.C., Canada, V5L 1C3

[21] Appl. No.: 09/190,572

[22] Filed: Nov. 12, 1998

[51] Int. Cl.[6] ..... B65B 1/04

[52] U.S. Cl. ..... 141/98; 141/346; 184/1.5

[58] Field of Search ..... 141/98, 346, 382, 141/383, 384; 251/216, 346, 351; 184/1.5

[56] References Cited

U.S. PATENT DOCUMENTS

| | | | |
|---|---|---|---|
| 5,579,815 | 12/1996 | Labonte' | 184/1.5 |
| 5,667,195 | 9/1997 | McCormick | 184/1.5 |
| 5,765,612 | 6/1998 | Morin | 184/1.5 |

OTHER PUBLICATIONS

1998 E & B Discount Marine Catalog, p. 216.

*Primary Examiner*—Steven O. Douglas

[57] ABSTRACT

A oil draining device for attachment to the drain hole of an oil pan to allow easy drainage of the oil out of the oil pan. The oil draining device includes an elongate flexible hose with a fitting is coupled to a first end of the flexible hose. The fitting has an axial bore and a lateral bore fluidly connecting the axial bore of the fitting to the first end of the flexible hose. A plug adaptor is extended through the axial bore of the fitting such that a middle portion of the plug adaptor is positioned in the axial bore of the fitting, a bottom portion of the plug adaptor is positioned adjacent the bottom face of the fitting, and a top portion of the plug adaptor is outwardly extended from the top face of the fitting. The plug adaptor has a plurality of flow passages therein each having an opening in the top portion of the plug adaptor and an opening in the middle portion of plug adaptor. A second end of the flexible hose has closure nut rotatably mounted thereto. A threaded insertion portion of a drain plug is inserted into an interior bore of the closure nut.

7 Claims, 2 Drawing Sheets

OIL DRAINING DEVICE

BACKGROUND OF THE INVENTION

1. Field of the Invention

The present invention relates to oil draining devices and more particularly pertains to a new oil draining device for attachment to the drain hole of an oil pan to allow easy drainage of the oil out of the oil pan.

2. Description of the Prior Art

The use of oil draining devices is known in the prior art. More specifically, oil draining devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,103,947; U.S. Pat. No. 4,706,722; U.S. Pat. No. 4,815,566; U.S. Pat. No. 4,976,233; U.S. Pat. No. 5,630,451; and U.S. Pat. No. Des. 388,801.

Prior art oil draining devices for marine engines require that the oil be drained with a pumping device extending into the oil pan through the oil dip stick because the drain hole of the oil pan is severely restricted.

In these respects, the oil draining device according to the present invention substantially departs from the conventional concepts and designs of the prior art, and in so doing provides an apparatus primarily developed for the purpose of attachment to the drain hole of an oil pan to allow easy drainage of the oil out of the oil pan.

SUMMARY OF THE INVENTION

In view of the foregoing disadvantages inherent in the known types of oil draining devices now present in the prior art, the present invention provides a new oil draining device construction wherein the same can be utilized for attachment to the drain hole of an oil pan to allow easy drainage of the oil out of the oil pan.

The general purpose of the present invention, which will be described subsequently in greater detail, is to provide a new oil draining device apparatus and method which has many of the advantages of the oil draining devices mentioned heretofore and many novel features that result in a new oil draining device which is not anticipated, rendered obvious, suggested, or even implied by any of the prior art oil draining devices, either alone or in any combination thereof.

To attain this, the present invention generally comprises an elongate flexible hose with a fitting is coupled to a first end of the flexible hose. The fitting has an axial bore and a lateral bore fluidly connecting the axial bore of the fitting to the first end of the flexible hose. A plug adaptor is extended through the axial bore of the fitting such that a middle portion of the plug adaptor is positioned in the axial bore of the fitting, a bottom portion of the plug adaptor is positioned adjacent the bottom face of the fitting, and a top portion of the plug adaptor is outwardly extended from the top face of the fitting. The plug adaptor has a plurality of flow passages therein each having an opening in the top portion of the plug adaptor and an opening in the middle portion of plug adaptor. A second end of the flexible hose has closure nut rotatably mounted thereto. A threaded insertion portion of a drain plug is inserted into an interior bore of the closure nut.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new oil draining device apparatus and method which has many of the advantages of the oil draining devices mentioned heretofore and many novel features that result in a new oil draining device which is not anticipated, rendered obvious, suggested, or even implied by any of the prior art oil draining devices, either alone or in any combination thereof.

It is another object of the present invention to provide a new oil draining device which may be easily and efficiently manufactured and marketed.

It is a further object of the present invention to provide a new oil draining device which is of a durable and reliable construction.

An even further object of the present invention is to provide a new oil draining device which is susceptible of a low cost of manufacture with regard to both materials and labor, and which accordingly is then susceptible of low prices of sale to the consuming public, thereby making such oil draining device economically available to the buying public.

Still yet another object of the present invention is to provide a new oil draining device which provides in the apparatuses and methods of the prior art some of the advantages thereof, while simultaneously overcoming some of the disadvantages normally associated therewith.

Still another object of the present invention is to provide a new oil draining device for attachment to the drain hole of an oil pan to allow easy drainage of the oil out of the oil pan.

Yet another object of the present invention is to provide a new oil draining device which includes an elongate flexible hose with a fitting is coupled to a first end of the flexible hose. The fitting has an axial bore and a lateral bore fluidly connecting the axial bore of the fitting to the first end of the flexible hose. A plug adaptor is extended through the axial bore of the fitting such that a middle portion of the plug adaptor is positioned in the axial bore of the fitting, a bottom portion of the plug adaptor is positioned adjacent the bottom face of the fitting, and a top portion of the plug adaptor is outwardly extended from the top face of the fitting. The plug adaptor has a plurality of flow passages therein each having an opening in the top portion of the plug adaptor and an opening in the middle portion of plug adaptor. A second end of the flexible hose has closure nut rotatably mounted thereto. A threaded insertion portion of a drain plug is inserted into an interior bore of the closure nut.

Still yet another object of the present invention is to provide a new oil draining device that provides a means for easily draining hard to access oil pans.

Even still another object of the present invention is to provide a new oil draining device that may be permanently affixed to a severely restricted access drain hole of a marine engine so that the user may drain the oil pan of the marine engine through the drain hole of the hole pan and not through the dip stick opening.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
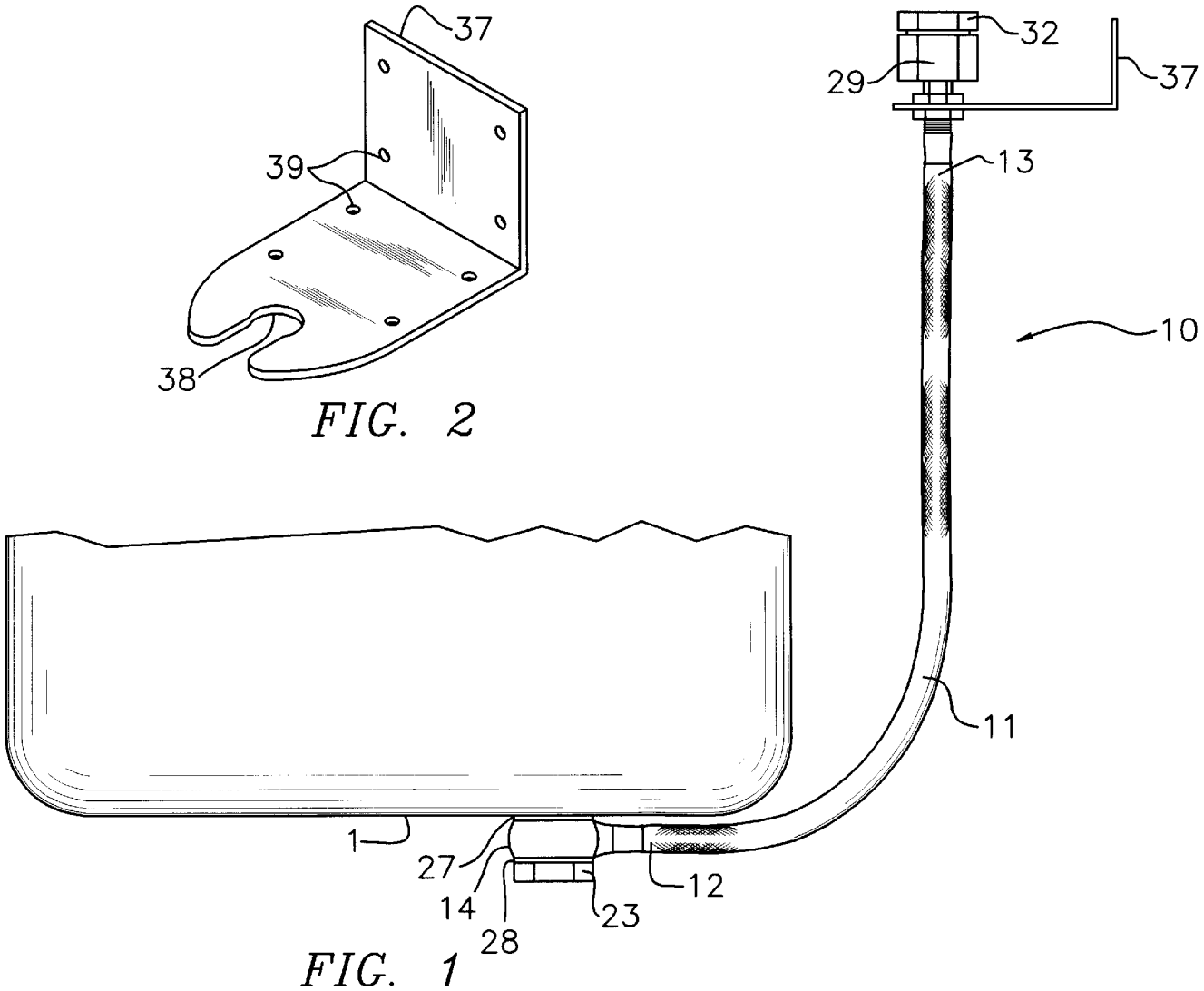
FIG. 1 is a schematic side view of a new oil draining device according to the present invention.
FIG. 2 is a schematic perspective view of the mounting bracket of the present invention.

With reference now to the drawings, and in particular to FIGS. 1 through 4 thereof, a new oil draining device embodying the principles and concepts of the present invention and generally designated by the reference numeral 10 will be described.

As best illustrated in FIGS. 1 through 4, the oil draining device 10 generally comprises an elongate flexible hose with a fitting is coupled to a first end of the flexible hose. The fitting has an axial bore and a lateral bore fluidly connecting the axial bore of the fitting to the first end of the flexible hose. A plug adaptor is extended through the axial bore of the fitting such that a middle portion of the plug adaptor is positioned in the axial bore of the fitting, a bottom portion of the plug adaptor is positioned adjacent the bottom face of the fitting, and a top portion of the plug adaptor is outwardly extended from the top face of the fitting. The plug adaptor has a plurality of flow passages therein each having an opening in the top portion of the plug adaptor and an opening in the middle portion of plug adaptor. A second end of the flexible hose has closure nut rotatably mounted thereto. A threaded insertion portion of a drain plug is inserted into an interior bore of the closure nut.

In closer detail, the oil draining device 10 is designed for attachment to a threaded drain hole 2 of an oil pan 1 of an engine, particularly a marine engine where the drain hole is in a severely restricted accessible position. Specifically, the oil draining device 10 comprises an elongate flexible hose 11 having a pair of opposite open ends 12,13, and a longitudinal axis extending between the ends of the flexible hose. Preferably, the flexible hose comprises an oil and gas resistant flexible rubber tube with a braided cover over the flexible rubber tube. In an ideal illustrative embodiment, the flexible hose has a length defined between the ends of the flexible hose between about 3 feet and about 5 feet.

Figure 3:
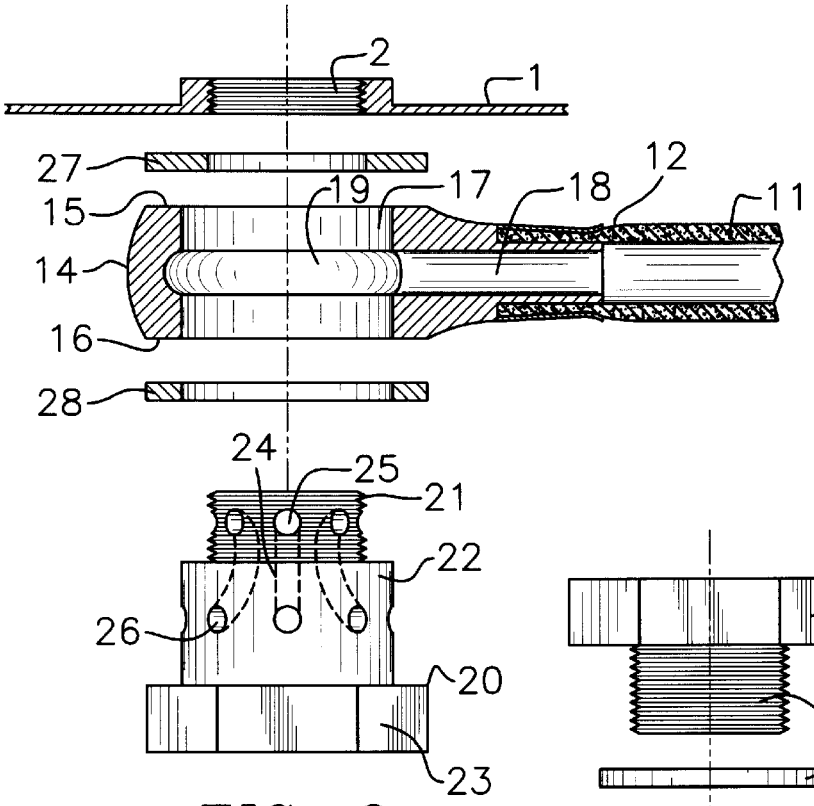
FIG. 3 is a schematic exploded partial cross sectional view of the portions of the present invention around the first end of the flexible hose.

A fitting 14 is coupled to a first of the ends 12 of the flexible hose. The fitting has generally circular top and bottom faces 15,16, and an generally cylindrical axial bore 17 extending therethrough between the top and faces of the fitting. Preferably, the axial bore has an axis extending substantially perpendicular to the top and bottom faces of the fitting. The fitting also has a generally cylindrical lateral bore 18 fluidly connecting the axial bore of the fitting to the first end of the flexible hose. The lateral bore of the fitting preferably has an axis extending substantially perpendicular to the axis of the axial bore of the fitting. As illustrated in FIG. 3, the axial bore of the fitting has an annular channel 19 therearound with the lateral bore of the fitting having an opening into annular channel of the axial bore of the fitting. Preferably, the annular channel of the axial bore of the fitting generally lies in a plane extending substantially perpendicular to the axis of the axial bore of the fitting.

With reference to FIG. 3, a plug adaptor 20 is provided for replacing the drain plug of the oil pan. The plug adaptor has a generally cylindrical threaded top portion 21, a generally cylindrical middle portion 22, and a generally hexagonal-shaped bottom portion 23. Preferably, the top, middle and bottom portions of the plug adaptor are substantially coaxial with each other. The plug adaptor is extended through the axial bore of the fitting such that the middle portion of the plug adaptor is positioned in the axial bore of the fitting, the bottom portion of the plug adaptor is positioned adjacent the bottom face of the fitting, and the threaded top portion of the plug adaptor is outwardly extended from the top face of the fitting.

The plug adaptor has a plurality of flow passages 24 therein. Each of the flow passages has a generally circular opening 25 in the threaded top portion of the plug adaptor and a generally circular opening 26 in the middle portion of plug adaptor. Preferably, the openings of the flow passages in the threaded top portion of the plug adaptor generally lie in a common plane. Similarly, the openings of the flow passages in the middle portion of the plug adaptor preferably generally lie in a common plane. In this preferred embodiment, the planes of the openings of the flow passages in the threaded top portion and the openings of the flow passages in the middle portion lie in substantially parallel planes to one another.

The openings of the flow passages in the middle portion of the plug adaptor are positioned adjacent the annular channel of the axial bore of the fitting to fluidly connect the flow passages to the lateral bore of the fitting. The threaded top portion of the plug adaptor is designed for threadable insertion into a threaded drain hole of a oil pan such that the openings of the flow passages in the threaded top portion of the plug adaptor are extended into the oil pan to fluidly connect the flow passages of the plug adaptor to the oil pan to permit oil to flow from the oil pan into the flow passages. The top face of the fitting is designed for positioning adjacent the oil pan when the threaded top portion is threadably inserted into the oil pan. The bottom portion of the plug adaptor is designed for engaging the jaws of a wrench device to rotate the plug adaptor to threadably insert and remove the threaded top portion from the drain hole of the oil pan.

Preferably, the plug adaptor has a pair of copper washers 27,28 disposed therearound. One of the washers of the plug adaptor is designed for positioning between top face of the fitting and the oil pan. The other washer of the plug adaptor is positioned around the middle portion of the plug adaptor between the bottom face of the fitting and the bottom portion of the plug adaptor.

Figure 4:
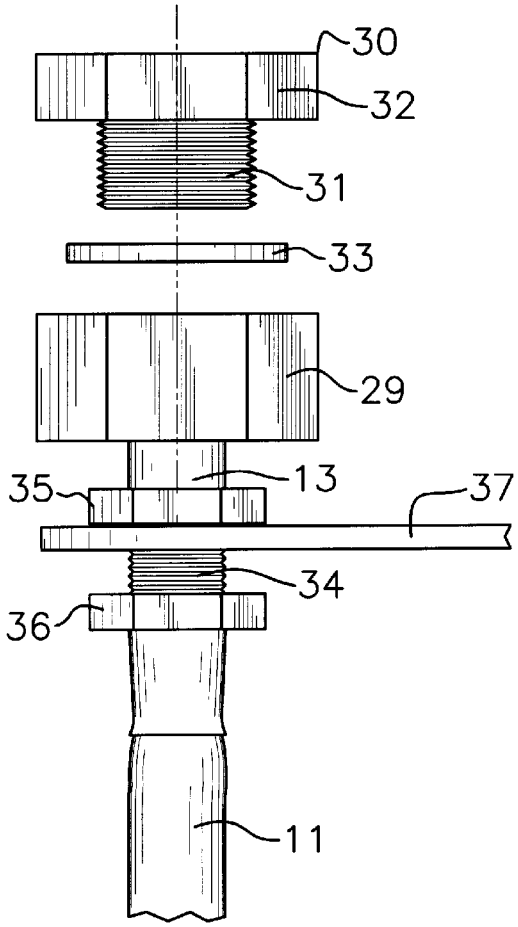
FIG. 4 is a schematic exploded side view of the portions of the present invention around the second end of the flexible hose.

With reference to FIG. 4, a second end 13 of the flexible hose has closure nut 29 rotatably mounted thereto to permit free rotation of the closure nut about the longitudinal axis of the flexible hose. The closure nut has a threaded interior bore in fluid communication with the flexible hose to permit passage of oil from the hose out of the threaded interior bore. Preferably, the threaded interior bore of the closure nut has an generally coaxial with the longitudinal axis of the flexible hose.

A drain plug 30 is provided having a generally cylindrical threaded insertion portion 31 and a generally hexagonal-shaped head portion 32. The threaded insertion portion of the drain plug is inserted into the threaded interior bore of the closure nut to substantially close passage of fluid through the closure nut. The head portion of the drain plug is designed for engaging the jaws of a wrench device to rotate the drain plug to threadably insert and remove the threaded insertion portion from the threaded interior bore of the closure nut. Preferably, the threaded insertion portion of the drain plug has a washer 33 disposed therearound. The washer of the threaded insertion portion of the drain plug is interposed between the closure nut and the head portion of the drain plug.

The flexible hose preferably has a threaded portion 34 adjacent the second end of the flexible hose. The threaded portion of the flexible hose terminates at an annular shoulder 35 adjacent the second end of the flexible hose. The threaded portion of the flexible hose also has a securing nut 36 threadably disposed thereon.

With reference to FIG. 2, a mounting bracket 37 is provided having a generally C-shaped cutout 38. As illustrated in FIGS. 1 and 4, the threaded portion of the flexible hose is extended through the cutout of the mounting bracket. The mounting bracket is positioned between the annular shoulder and the securing nut, the annular shoulder and the securing nut holding the mounting bracket therebetween to the flexible hose. The mounting bracket has a plurality of mounting holes 39 therethrough designed for extending fasteners therethrough to mount the mounting bracket to a support structure above the height of the drain hole of the drain hole. Optionally, the mounting bracket may be bent into a generally L-shaped configuration dividing the mounting bracket into a pair of portions extending generally perpendicular to one another as shown in FIGS. 1 and 2 or be left in a substantially planar unbent configuration. In the bent configuration, each of the portions of the mounting bracket has a number of the plurality of mounting holes located therein so that each portion of the mounting bracket may be secured to the support structure.

In use to drain the oil pan, the drain plug is removed from the closure nut so that oil may flow out of the oil pan through the flow passages of the plug adapted into the flexible hose and out the second end of the flexible hose to be collected in a container. When the oil pan is drained. The drain plug may be re-inserted into the threaded interior bore of the closure nut to prevent oil from draining out of the oil pan through the oil draining device.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A oil draining device for attachment to a threaded drain hole of an oil pan, said oil draining device comprising:

an elongate flexible hose having a pair of opposite ends;

a fitting being coupled to a first of said ends of said flexible hose, said fitting having top and bottom faces, and an axial bore extending therethrough between said top and faces of said fitting;

said fitting having a lateral bore fluidly connecting said axial bore of said fitting to said first end of said flexible hose;

said axial bore of said fitting having an annular channel therearound, said lateral bore of said fitting opening into annular channel of said axial bore of said fitting;

a plug adaptor having a threaded top portion, a middle portion, and a bottom portion;

said plug adaptor being extended through said axial bore of said fitting such that said middle portion of said plug adaptor is positioned in said axial bore of said fitting, said bottom portion of said plug adaptor is positioned adjacent said bottom face of said fitting, and said top portion of said plug adaptor is outwardly extended from said top face of said fitting;

said plug adaptor having a plurality of flow passages therein, each of said flow passages having an opening in said top portion of said plug adaptor and an opening in said middle portion of plug adaptor;

said openings of said flow passages in said middle portion of said plug adaptor being positioned adjacent said annular channel of said axial bore of said fitting to fluidly connect said flow passages to said lateral bore of said fitting;

said top portion of said plug adaptor being adapted for threadable insertion into a threaded drain hole of a oil pan such that said openings of said flow passages in said top portion of said plug adaptor are extended into the oil pan to fluidly connect said flow passages of said plug adaptor to the oil pan;

a second end of said flexible hose having closure nut rotatably mounted thereto;

said closure nut having a threaded interior bore in fluid communication with said flexible hose; and a drain plug having a threaded insertion portion and a generally hexagonal-shaped head portion, said threaded insertion portion of said drain plug being inserted into said interior bore of said closure nut.

2. The oil draining device of claim 1, wherein said axial bore has an axis extending substantially perpendicular to said top and bottom faces of said fitting, wherein said lateral bore of said fitting has an axis extending substantially perpendicular to said axis of said axial bore of said fitting, and wherein said annular channel of said axial bore of said fitting generally lies in a plane extending substantially perpendicular to said axis of said axial bore of said fitting.

3. The oil draining device of claim 1, wherein said bottom portion of said plug adaptor is generally hexagonal-shaped for engaging the jaws of a wrench device to rotate said plug adaptor to threadably insert and remove said threaded top portion from the drain hole of the oil pan.

4. The oil draining device of claim 1, wherein said openings of said flow passages in said top portion of said plug adaptor generally lie in a common plane, wherein said openings of said flow passages in said middle portion of said plug adaptor generally lie in a common plane, and wherein said planes of said openings of said flow passages in said top portion and said openings of said flow passages in said middle portion lying lie in substantially parallel planes to one another.

5. The oil draining device of claim 1, further comprising a mounting bracket being coupled to said flexible hose adjacent said second end of said flexible hose, said mounting bracket having a plurality of mounting holes therethrough adapted for extending fasteners therethrough to mount said mounting bracket to a support structure.

6. The oil draining device of claim 5, wherein said flexible hose has a threaded portion adjacent said second end of said flexible hose, wherein said threaded portion of said flexible hose terminates at an annular shoulder adjacent said second end of said flexible hose, wherein said threaded portion of said flexible hose has a securing nut threadably disposed thereon, wherein said mounting bracket has a generally C-shaped cutout, wherein said threaded portion of said flexible hose is extended through said cutout of said mounting bracket, wherein said mounting bracket is positioned between said annular shoulder and said securing nut, and wherein said annular shoulder and said securing nut hold said mounting bracket therebetween to said flexible hose.

7. A oil draining device for attachment to a threaded drain hole of an oil pan, said oil draining device comprising:

an elongate flexible hose having a pair of opposite ends, and a longitudinal axis extending between said ends of said flexible hose;

a fitting being coupled to a first of said ends of said flexible hose, said fitting having top and bottom faces, and an axial bore extending therethrough between said top and faces of said fitting, said axial bore having an axis extending substantially perpendicular to said top and bottom faces of said fitting;

said fitting having a lateral bore fluidly connecting said axial bore of said fitting to said first end of said flexible hose, said lateral bore of said fitting having an axis extending substantially perpendicular to said axis of said axial bore of said fitting;

said axial bore of said fitting having an annular channel therearound, said lateral bore of said fitting opening into annular channel of said axial bore of said fitting;

said annular channel of said axial bore of said fitting generally lying in a plane extending substantially perpendicular to said axis of said axial bore of said fitting;

a plug adaptor having a generally cylindrical threaded top portion, a generally cylindrical middle portion, and a generally hexagonal-shaped bottom portion;

said plug adaptor being extended through said axial bore of said fitting such that said middle portion of said plug adaptor is positioned in said axial bore of said fitting, said bottom portion of said plug adaptor is positioned adjacent said bottom face of said fitting, and said top portion of said plug adaptor is outwardly extended from said top face of said fitting;

said top, middle and bottom portions of said plug adaptor being substantially coaxial with each other;

said plug adaptor having a plurality of flow passages therein, each of said flow passages having an opening in said top portion of said plug adaptor and an opening in said middle portion of plug adaptor;

said openings of said flow passages in said top portion of said plug adaptor generally lying in a common plane, said openings of said flow passages in said middle portion of said plug adaptor generally lying in a common plane;

said planes of said openings of said flow passages in said top portion and said openings of said flow passages in said middle portion lying in substantially parallel planes to one another;

said openings of said flow passages in said middle portion of said plug adaptor being positioned adjacent said annular channel of said axial bore of said fitting to fluidly connect said flow passages to said lateral bore of said fitting;

said top portion of said plug adaptor being adapted for threadable insertion into a threaded drain hole of a oil pan such that said openings of said flow passages in said top portion of said plug adaptor are extended into the oil pan to fluidly connect said flow passages of said plug adaptor to the oil pan;

said top face of said fitting being adapted for positioning adjacent the oil pan when said top portion is threadably inserted into the oil pan;

said plug adaptor having a pair of washers disposed therearound, one of said washers of said plug adaptor being adapted for positioning between top face of said fitting and the oil pan, the other of said washers of said plug adaptor being positioned around said middle portion of said plug adaptor between said bottom face of said fitting and said bottom portion of said plug adaptor;

a second end of said flexible hose having closure nut rotatably mounted thereto;

said closure nut having a threaded interior bore in fluid communication with said flexible hose, said interior bore of said closure nut having an generally coaxial with said longitudinal axis of said flexible hose;

a drain plug having a threaded insertion portion and a generally hexagonal-shaped head portion, said threaded insertion portion of said drain plug being inserted into said interior bore of said closure nut;

said threaded insertion portion of said drain plug having a washer disposed therearound, said washer of said threaded insertion portion of said drain plug being interposed between said closure nut and said head portion of said drain plug;

said flexible hose having a threaded portion adjacent said second end of said flexible hose, said threaded portion of said flexible hose terminating at an annular shoulder adjacent said second end of said flexible hose;

said threaded portion of said flexible hose having a securing nut threadably disposed thereon;

a mounting bracket having a generally C-shaped cutout, said threaded portion of said flexible hose being extended through said cutout of said mounting bracket;

said mounting bracket being positioned between said annular shoulder and said securing nut, said annular shoulder and said securing nut holding said mounting bracket therebetween to said flexible hose;

said mounting bracket having a plurality of mounting holes therethrough adapted for extending fasteners therethrough to mount said mounting bracket to a support structure; and said mounting bracket having a generally L-shaped configuration dividing said mounting bracket into a pair of portions extending generally perpendicular to one another, each of said portions of said mounting bracket having a number of said plurality of mounting holes located therein.

* * * * *